US009181741B2

(12) United States Patent
Bettinzoli

(10) Patent No.: US 9,181,741 B2
(45) Date of Patent: Nov. 10, 2015

(54) HINGES PROVIDED WITH ELASTIC MEANS AND DAMPENER

(75) Inventor: Angelo Bettinzoli, Bareggio (IT)

(73) Assignee: FARINGOSI HINGES, S.R.L., Ospitaletto (BS) (IT)

( * ) Notice: Subject to any disclaimer, the term of this patent is extended or adjusted under 35 U.S.C. 154(b) by 0 days.

(21) Appl. No.: 14/118,047

(22) PCT Filed: Jun. 8, 2011

(86) PCT No.: PCT/IB2011/001270

§ 371 (c)(1),
(2), (4) Date: Feb. 4, 2014

(87) PCT Pub. No.: WO2012/168748

PCT Pub. Date: Dec. 13, 2012

(65) Prior Publication Data

US 2014/0130302 A1 May 15, 2014

(51) Int. Cl.
*E05F 1/12* (2006.01)
*E05D 11/00* (2006.01)
(Continued)

(52) U.S. Cl.
CPC ..... *E05D 11/00* (2013.01); *E05F 1/1261* (2013.01); *E05F 5/02* (2013.01); *E05D 11/1064* (2013.01); *E05F 1/1276* (2013.01); *E05Y 2201/21* (2013.01); *E05Y 2201/218* (2013.01); *E05Y 2201/256* (2013.01); *E05Y 2201/264* (2013.01); *E05Y 2201/412* (2013.01);
(Continued)

(58) Field of Classification Search
CPC ..... E05F 1/1276; E05F 5/02; E05F 5/027; E05F 5/10; Y10T 16/53836; Y10T 16/53832; Y10T 16/5383; Y10T 16/538
See application file for complete search history.

(56) References Cited

U.S. PATENT DOCUMENTS 6,397,836 B1 * 6/2002 Pelletier et al. ..... 126/194
6,789,293 B2 * 9/2004 Habegger et al. ..... 16/343
(Continued)

FOREIGN PATENT DOCUMENTS

DE 20 2007 012 603 U1 1/2009
DE 10 2009 022 737 A1 3/2011
EP 1 847 670 A2 10/2007

OTHER PUBLICATIONS

International Search Report of PCT/IB2011/001270 dated Feb. 23, 2012.

*Primary Examiner* — Jeffrey O Brien
(74) *Attorney, Agent, or Firm* — Lucas & Mercati, LLP

(57) ABSTRACT

A hinge for a closing door of a compartment, of the type having a first and a second body, respectively integral to the door and to the frame of the corresponding compartment, or vice versa, and mutually hinged by at least one pin, first elastic means mounted on the second body and acting upon the first body, and at least one dampening device fixed to the second body, acting upon the first body and actuated by at least a first slider, functionally connected to the dampener, and by at least a second slider, configured for engaging, directly or indirectly, the aforesaid first body in correspondence of at least a certain angular range assumed by the first body with respect to the second body during their relative rotation, whereby the second slider is actuated in translation by the first body when engaged therewith, as well as constraining means between the first slider and the second slider. Advantagiously, the aforesaid constraining means include at least a lever pivoted to the second body, and the aforesaid first and second slider are constrained at least in rotation to one lever.

10 Claims, 3 Drawing Sheets

(51) Int. Cl.
*E05F 5/02* (2006.01)
*E05D 11/10* (2006.01)

(52) U.S. Cl.
CPC ..... *E05Y 2201/604* (2013.01); *E05Y 2201/626* (2013.01); *E05Y 2201/638* (2013.01); *E05Y 2201/688* (2013.01); *E05Y 2600/46* (2013.01); *E05Y 2800/22* (2013.01); *E05Y 2900/308* (2013.01); *Y10T 16/5383* (2015.01); *Y10T 16/5388* (2015.01)

(56) References Cited

U.S. PATENT DOCUMENTS 6,892,424 B1 * 5/2005 Habegger et al. ..... 16/289
6,986,187 B2 * 1/2006 Cummins et al. ..... 16/286
7,017,232 B1 * 3/2006 Priddy ..... 16/286
7,096,535 B2 * 8/2006 Lin ..... 16/287
7,134,169 B2 * 11/2006 Habegger et al. ..... 16/297
7,721,388 B2 * 5/2010 Lee ..... 16/286
8,533,914 B2 * 9/2013 Vanini ..... 16/286
8,677,565 B2 * 3/2014 Vanini ..... 16/286
8,683,653 B2 * 4/2014 Bettinzoli ..... 16/286
8,806,718 B2 * 8/2014 Elkasevic ..... 16/286
8,806,719 B2 * 8/2014 Kleeman et al. ..... 16/286
8,925,542 B2 * 1/2015 White et al. ..... 126/194
2003/0056328 A1 * 3/2003 Habegger et al. ..... 16/343
2007/0119021 A1 * 5/2007 Habegger et al. ..... 16/297
2007/0209654 A1 * 9/2007 Wang ..... 126/194
2007/0283532 A1 * 12/2007 Vanini ..... 16/277
2008/0115322 A1 * 5/2008 Migli ..... 16/283
2008/0201907 A1 * 8/2008 Vanini ..... 16/342
2008/0289144 A1 * 11/2008 Vanini ..... 16/221
2010/0212112 A1 * 8/2010 Steurer et al. ..... 16/286
2010/0236021 A1 * 9/2010 Sir Louis ..... 16/303
2010/0257698 A1 * 10/2010 Vanini ..... 16/233
2010/0281650 A1 11/2010 Kleemann et al.
2011/0017191 A1 * 1/2011 White et al. ..... 126/198
2011/0072617 A1 * 3/2011 Lin et al. ..... 16/298
2011/0146654 A1 * 6/2011 Basavalingappa Mudbasal et al. ..... 126/194
2011/0146655 A1 * 6/2011 Basavalingappa Mudbasal et al. ..... 126/194
2012/0067333 A1 * 3/2012 Mirshekari et al. ..... 126/192
2013/0239364 A1 * 9/2013 SirLouis ..... 16/50
2013/0300274 A1 * 11/2013 Elkasevic et al. ..... 16/327
2013/0312222 A1 * 11/2013 Elkasevic et al. ..... 16/327
2014/0345082 A1 * 11/2014 Collene et al. ..... 16/58

* cited by examiner

HINGES PROVIDED WITH ELASTIC MEANS AND DAMPENER

CROSS-REFERENCE TO RELATED APPLICATIONS

This application is a 371 of PCT/M2011/001270 filed on Jun. 8, 2011, the contents of which are incorporated herein by reference.

FIELD OF THE INVENTION

The present invention relates to a hinge for a closing door of a compartment, for example for an oven chamber, an electrical appliance, a cabinet or the like, of the type in which a first mobile body, fixed to the door, and a second mobile body, fixed to the frame of the compartment, are hinged to each other and their mutual motion is counteracted and/or facilitated by appropriate elastic means and by at least one dampener.

Note that the term "door", here and below, refers to any element, preferably in the form of a sheet, responsible for closing, even partially, an opening for the access to any type of compartment, and therefore this term is intended to also comprise window-shutters, swing-doors, doors, windows, etc.

BACKGROUND ART

It is a known art to make hinges for doors closing compartments that comprise two bodies hinged together, and fixed respectively to the door and to the frame of the compartment, in which one of the two bodies houses appropriate elastic means, usually consisting of a cylindrical helical spring, acting on the other hinge body so as to counteract, or facilitate, the motion in one direction and/or towards certain angular positions assumed by a body with respect to the other.

To such a structure, it is known to couple a dampener, generally of a fluidic cylinder-piston type, which is configured to exert a further braking action during the respective motion in at least one direction, of the two hinge bodies, and therefore of the door with respect to the compartment, in order to partially counteract the action of the elastic means and/or prevent that in the fully open or fully closed position of the compartment undue shock between door and compartment frame can occur due to an excessive force imparted by the user to the door during the closing or opening thereof.

For example, U.S. Pat. No. 6,397,836, granted on behalf of THE STANLEY WORKS, teaches how to create a hinge of the above mentioned type, in which a mobile body, constrained to the door, and a fixed body, constrained to the respective compartment frame, are reciprocally hinged, and wherein a spring and fluidic actuated dampener are housed on the mobile hinge body and are simultaneously urged by sliders pushed by a connecting rod, which is in turn hinged at one end to the fixed body and at the other end is constrained to one or more of said sliders. The spring and the dampener, constrained to the mobile body, therefore exert a continuous counteracting, or facilitating action to the respective sliders displacement and therefore a continuous counteracting, or facilitating action, to the relative rotation of the mobile body with respect to the fixed hinge body.

In this way, during the relative motion of the mobile hinge body with respect to the fixed one, the clockwise and counterclockwise rotational motions are variously counteracted, or facilitated, by the elastic means and the dampener. Moreover, thanks to the dampener, it is possible to avoid any impact at least during the closing of the door.

Said solution, foreseeing that the dampener is continually stressed during the opening or closing stroke of the door, requires a careful designing of the dampener itself, which must not only be actuated in both rotation directions of the mobile hinge body, and therefore of the door, but also cannot be configured neither to exert an excessive dampening action upon the hinge, which would make the opening and closing of the door itself difficult, nor to exert a reduced dampening action, which would defeat the purpose of its use.

Considering the fact that the main purpose in using a dampener in a hinge with motion counteracting elastic means is, in many applications, to prevent the door frame from slamming into its respective compartment frame when the door reaches its closing position has been proposed in European Patent EP-A-1847670, on behalf of NUOVA STAR, to allow the actuation of the dampener only when the door to which the hinge is coupled, reaches its closed position.

More specifically, the NUOVA STAR patent informs on how to make a hinge provided both with elastic means housed in the mobile hinge body for the purpose of counteracting or facilitating the opening/closing movement of the hinge, and of a fluidic type dampener, also constrained to the mobile hinge body, which counteracts the motion of the hinge only in the vicinity of its closed position, being actuated by a slider, slidable on the mobile hinge body, which is configured to engage with the respective fixed body only when the mobile body, and therefore the door, reaches its closed position.

This solution, which provides that the dampener actuating slider is pushed due to the support of the fixed hinge body only at a certain angle range, and transmits a translational and substantially unaltered motion to the dampener, suffers the drawback that, because of the necessarily reduced hinge size, the slider translation stroke driving the dampener results particularly reduced, and therefore the displacement of the dampener actuating element results in being considerably limited, thus making it necessary to use dampeners designed "ad hoc", capable of exerting a proper dampening action even in the presence of small movements of their actuating element (for example, the piston in a fluidic cylinder-piston type dampener).

But these customized dampeners, as will be clear to one skilled in the art, appear to be bulky and/or of complex construction and therefore expensive.

This drawback, in fact, prevents the use of this type of hinge in applications where it is necessary to concentrate the dampening action of the dampener in a small angular range reached by the mobile hinge body with respect to the respective fixed body and/or when the hinge bulk dimensions should be limited because of the geometry of the door and the respective compartment.

Note also that the direct transmission of motion from the abovementioned slider to the dampener actuating element, as described in EP-A-1847670, can also lead, though in rare cases and depending on the different dimensions of the hinge, to an excessive stroke of the dampener actuating slider that directly results into an excessive movement of the dampener actuating element itself, thereby making it necessary, also in this case, the predisposition of an expensive and complex customized dampener.

Also note that the direct transmission, i.e. unchanged, of the motion from the fixed body of the hinge to the dampener actuating slider, thanks to the pressure exerted by the fixed body when the actuating slider comes to rest upon the latter, does not prevent jamming of the dampener, resulting in a rebound of the door when the door closing speed constrained to said fixed body is excessive, and therefore when the impact between the slider and the fixed body has an un-negligible energy.

Finally, as one skilled in the art can easily understand, since in the applications described in EP-A-1847670, the amount of displacement of the actuating slider is in relation to the amount of mechanical clearance that is created during the medium life-span of the dampener, it becomes evident that, over time, the effectiveness of the dampener decreases more and more, until the clearance that is created between the mechanical parts results in dampener malfunction.

It is therefore the aim of the present invention to create a hinge of the aforementioned type, which solves the drawbacks of the known prior art, mentioned above, therefore allowing the dampener to operate in any angular range, large or small as desired, during the movement of the mobile hinge body with respect to the fixed one without dampener jamming, resulting in the rebound of the door coupled to the hinge, and without requiring the use of a complex and expensive custom-made dampener.

It is another aim of the present invention to provide a hinge having counteracting/facilitating elastic means of the motion of the mobile hinge body with respect to the fixed one that does not present excessive bulk dimensions and allows an effective dampening action, at least when the mobile hinge body moves within a certain angular range with respect to its respective fixed body.

A further aim of the present invention is to create a hinge of the aforementioned type which allows the dampener to act effectively during the entire life-span of the hinge, without the clearance which is formed between mechanical parts during the use of the hinge itself, results in dampener malfunction.

SUMMARY OF THE INVENTION

These and other aims are achieved by the hinge according to the first independent claim and the subsequent dependent claims.

The hinge for a closing door of a compartment, according to the present invention comprises a first and a second body, respectively, integral to the door and the compartment frame, or vice versa, and mutually hinged by at least one pin. The hinge further comprises first elastic means constrained to the second hinge body and acting upon its respective first body and at least one dampening device, being also fixed to said second body, and acting upon the first body, which is actuated by at least a first slider, functionally connected to the dampener, and by at least a second slider, configured for engaging, directly or indirectly, the first hinge body in correspondence of at least a certain angular range assumed by the first body with respect to the second one, during the relative rotation of one with respect to the other. The aforesaid second slider is thus actuated in translation from the first body when said second slider comes to be engaged with said first hinge body. Furthermore, according to the present invention the hinge comprises constraining means between the first and second slider that, advantageously comprise at least one lever pivoted to the second hinge body such that the first and second slider are constrained at least in rotation to said lever.

In particular, according to a preferred embodiment of the present invention, said lever, mutually constraining the aforesaid first and second slider is a one-armed lever which is hinged at one end to the aforesaid second hinge body and which provides that the two sliders are constrained at least pivoting to it, e.g. pivoted or constrained by a pin slidable within a slot obtained into said lever, at two different distances from its end hinged to the second body, thus obtaining, thanks to the different arm connecting them to the center of rotation of said lever, a different amount of displacement of one slider with respect to the other.

This allows, as will be clear to one skilled in the art, to obtain a different translation stroke of the first slider with respect to the second slider, thus obtaining, though facing a limited displacement of the second slider, when driven in translation by the first hinge body, a larger displacement of the first slider, intended to directly or indirectly actuate the aforesaid dampener.

This solution, besides allowing to reduce the bulk of the hinge, makes implementation of customized dampeners unnecessary and allows for efficient operation of the hinge described above, even when the geometry of the hinge itself requires that the angular range, in which during the motion of the hinge the dampener is actuated, is limited and therefore the translation stroke of the second slider is in itself also limited.

In other words, the interposition of a lever between said first and second dampener actuating slider, allows variations of the law of motion of the motion transmission from the second to the first slider, so as to obtain the correct displacement of the dampener actuating element in use and thus obtaining an effective dampening action by the latter.

Moreover, as will be clear to one skilled in the art, the dampening action of the dampener, thanks to the use of the aforesaid lever that, according to a particular aspect of the present invention, can amplify the displacement of the first slider, acting upon the dampener, with respect to the second slider, pushed by the first hinge body, will experience only limited clearance due to the wear of mechanical parts during the life-span of the hinge.

Finally, the use of said lever between the first and second dampener actuating sliders, allowing variations of the law of motion transmission from the second slider to the shaft of the dampener actuating element, and also, above all, partially absorbing the energy developed during the impact between the first hinge body and the second slider, allows to reduce possible jamming of said dampener, resulting in rebound of the door associated with it due to the excessive speed of closing or opening of the door constrained to the hinge.

According to a preferred aspect of the present invention, the dampener is of the fluidic type, preferably consisting of a piston sliding in a respective cylinder containing a dampening fluid.

According to a particular embodiment of this invention, the aforesaid first elastic means, preferably made of a cylindrical helical torsion spring, are constrained to the second hinge body and are actuated by way of a spring-guide rod, which is constrained directly or indirectly, to the first hinge body.

According to another aspect of the present invention, the aforesaid first body is configured by a lever with two arms, one of which is integrally fixed to the door and the other constrained to the spring-guide rod of the first elastic means.

In another preferred embodiment, the hinge further comprises a follower mounted slidable on the second hinge body and pushed, by appropriate elastic means, engaged with a cam profile obtained on the first arm of the lever body disengaged from the door.

BRIEF DESCRIPTION OF THE FIGURES

Now certain embodiments of the hinge according to the present invention will be described, only by way of example and without limitation, with reference to the attached figures, wherein.

DETAILED DESCRIPTION OF SOME PREFERRED EMBODIMENTS OF THE PRESENT INVENTION

With first reference to the hinge shown in FIGS. 1 to 4, according to a particular aspect of the present invention, it comprises a first body 1, integral to the door of a compartment and therefore moving with it, a second body 2, integral to the compartment frame and therefore fixed, and a pin 3 which constrains in rotation said mobile body 1 to the fixed body 2.

Figure 4:
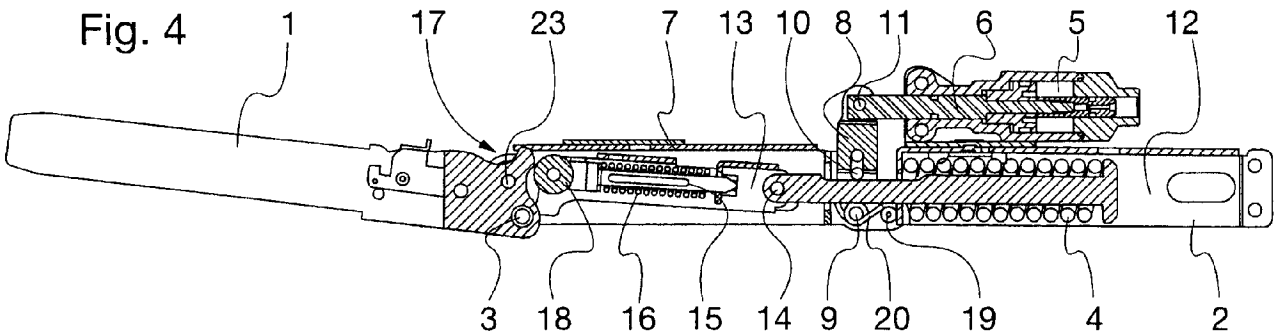
FIG. 4 is a side view partially in section of the hinge of FIG. 1, seen in its completely open position.

Thanks to the pin 3, the mobile body 1 is thus free to rotate with respect to the fixed body 2 for an angular range extending, thanks also to appropriate stops not represented, from a closing position of the compartment, in which the mobile body 1 is substantially orthogonal to the fixed body 2 (see FIG. 2), to an opening position of the compartment, in which said mobile body 1 is substantially aligned with the fixed body 2 (see FIG. 4).

The hinge herein represented is particularly suitable for use on an oven or another appliance, in which the pin 3 extends along a substantially horizontal axis, and therefore the motion of opening and closing of the door fixed to the mobile body 1 is influenced by the force of gravity.

The fixed body 2 has first elastic means 4, consisting in particular of a cylindrical helical metal spring, which are functionally interposed between the mobile body 1 and the fixed body 2, and actuated by way of appropriate means 12, 13, 14, 23, so as to counteract the opening motion of the door and, in case the pin 3 extends along a substantially horizontal axis, to balance the force of gravity.

More specifically, in the hinge illustrated in FIGS. 1 to 4, the cylindrical helical spring 4 of a torsion and compression activated type, is housed within the fixed body 2 and presents a first end constrained to the fixed body 2 itself and a second end retained by the head, suitably shaped of the spring-guide rod 12, which is mounted slidable within said fixed body 2.

The spring-guide rod 12 is also rotatingly hinged by a pin 14, at its opposite end to that of the shaped head, at the end of a further rod-shaped element 13 which, in turn, is hinged by a pin 23, placed in correspondence of the other end thereof, to a projecting region of the first mobile hinge body 1.

In greater detail, the pin 23 is placed upon the aforesaid projecting region of the first mobile body 1 along a direction that connects the pin 23 to the pin 3, which is angled with respect to the axis of extension of the remaining part of the mobile body 1 that is intended to be integral to the compartment door. In this way, the mobile body 1 assumes a substantially "L" shape with respect to the pin 3 hinged to the fixed body 2, and therefore acting as a lever with two arms, in which one arm is integral to the door and the other arm is functionally coupled, via the pin 23, the rod-shaped element 13, the pin 14, and the spring-guide rod 12, to the cylindrical helical spring 4.

Note that the spring-guide rod 12, which constitutes a first rod-shaped element, the pin 14, the second rod-shaped element 13 and the pin 23, constitute the aforesaid actuating means for actuating said first elastic means, i.e. of the cylindrical helical spring 4.

Note also that, although are described actuating means of the cylindrical helical spring 4, or therefore the first elastic means, consisting of two rod-shaped elements 12, 13 hinged 14, 23 together and to the first mobile hinge body 1, any other mechanical component known in the art that enables actuation of the first elastic means 4 as a function of the displacement of the mobile body 1 with respect to the mobile body 2, can be alternatively used.

The hinge according to the present invention also comprises a dampener 5 which is mounted integral with the fixed body 2 and is actuated by at least a first slider 6 constrained through a one-armed lever 8, hinged by a pin 9 to the fixed body 2, and at least a second slider 7, which is in turn slidingly mounted on the fixed body 2, and is configured to be engaged with, and be driven in translation by the mobile body 1 only when the latter, during the relative motion of the mobile body 1 with respect to the fixed body 2, is located in a predetermined angular range, preferably located near the closing or opening position of the door fixed to the mobile body 1. The first slider 6 and the second slider 7 are constrained, at least rotatingly, to the lever 8, at different distances from the pivoting pin 9 of said lever 8 to the fixed hinge body 2.

More specifically, in the particular hinge shown in FIGS. 1 to 4, the dampener 5 is a fluidic cylinder-piston type, in which the piston rod coincides with the first slider 6 and has its free end constrained by a pin 11 to the lever 8, substantially in correspondence to one end (the top one in the figures) of said lever 8.

The lever 8, which in the embodiment of FIGS. 1-4 is a one-armed lever, is therefore constrained at its other end (the lower one in the figures), by a pin 9, to the fixed hinge body 2 and is also constrained in an intermediate position by a pin 10, to a second slider 7.

As can be seen from FIGS. 1-4, both the pin 10 and the pin 11 are slidingly and rotatingly engaged to the lever 8 within their respective slots obtained on the same lever 8, and extended substantially along the axis of the latter, which, despite having a limited length, allow absorption of certain transverse displacements to which the sliders 6 and 7 may be subjected to during the rotation of the mobile body 1 with respect to the fixed hinge body 2.

It is of course possible, in alternative embodiments of the present invention, to directly pivot the sliders to the lever 8, thus not providing slots in which the constraining pins 10 and 11 of the sliders 6 and 7 can move along the axis of the lever 8, or provide one or more slots.

The second slider 7, in the hinge described herein, is slidingly mounted on the fixed body 2, and has its ends not constrained to the lever 8 substantially arranged in correspondence to the end of the fixed body 2 placed near the mobile body 1.

Said slider 7 is arranged so as to be engaged with a specific projecting region of the mobile body 1 only when the latter is near its closed position (FIGS. 2 and 3) i.e. when the door is about to close the compartment, and is therefore driven in translation by the same mobile body 1, in a direction opposite to that of engagement between the slider 7 and the latter, until complete closing of the compartment by the door.

The translational drive of the second slider 7 by way of the mobile body 1, involves, as will be clear to one skilled in the art, the actuating in rotation of the lever 8 and therefore the translation—with a different amount of displacement with respect to that received by the slider 7 of the first slider 6, which thus directly actuates the dampener 5, that in this way exerts a dampening action only when the door is near to closing the compartment.

One can see, as already mentioned, that thanks to different distances between the points of constraint 11 and 10 of the two sliders 6 and 7 on the lever 8 with respect to the pin 9, the displacement of the first slider 6, constrained in 11 to the lever 8 at a greater distance from the pin 9, will be of greater amount than the displacement of the second slider 7, constrained in 10 to the lever 8 at a point closest to the pin 9. Consequently, at the occurrence of a certain displacement in translation of the second slider 7, due to its engagement with the mobile body 1, there will be a greater amount of displacement in translation of the first slider 6, which will in this way effectively actuate the dampener 5, even in the presence of small displacements of the second slider 7.

Also note that, in the hinge herein shown in FIGS. 1 to 4, the dampener 5 is fixed to the fixed hinge body 2 in a detached position (higher in the figures) from the same fixed body 2, i.e. is arranged along a direction parallel to that along which the fixed hinge body 2 develops.

Moreover, according to a particular aspect of the present invention, the hinge shown herein comprises second elastic means 20, formed in particular by a wire flexing actuated spring, and retained to the fixed body 2 by a tip 19, which act upon the lever 8, so as to counteract the translation movement of the sliders 6 and 7 distanced from the end of the fixed body 2 in which the pin 3 is placed, i.e. counteracting though slightly, the displacement of the sliders 6 and 7 appointed to actuate the dampener 5.

In other words, the wire spring 20 pushes, via the lever 8, the slider 7 in the direction of the mobile body 1, and therefore coupled with said mobile body 1, when there is the engagement of the latter with the second slider 7, or at least in correspondence of said end of the fixed body 2 in which occurs the hinging through the pin 3, to the mobile body 1.

Finally, the hinge represented herein comprises a follower 18, slidingly mounted on the fixed body 2, more specifically constrained in translation by a shaft 15 to the second rod-shaped element 13 of the above actuating means of the cylindrical helical torsion spring 4, which is induced to follow, thanks to the third elastic means 16, functionally interposed between the rod-shaped element 13 and the follower 18, a cam-shaped profile 17, obtained on one end of the mobile hinge body 1.

More specifically, the follower 18 of the hinge illustrated herein comprises a pin, on which is coaxially mounted a swivelling roller, being integral to the shaft 15, which is slidingly mounted in a perforated projecting wall of the rod-shaped element 13. Between said projecting wall of the rod-shaped element 13 and the follower 18, extends a cylindrical helical torsion spring 16, constituting the aforesaid third elastic means, which pushes into engagement the swivelling roller of the follower 18 with the cam-shaped surface 17 of the mobile body 1.

Note that the cam-shaped surface 17, particularly provided with a "tooth" shaped portion, is obtained on the mobile body 1 in a projection of the latter, which forms, albeit in a limited way, the smaller arm of a "L" shaped structure, in which the other arm is instead integral with the door. Thus, operationally, the mobile body 1 acts as an "L" shaped lever with two arms, pivoted in 3, in which one arm is integral with the door and the other arm is pivoted in 23 to the above mentioned actuating means 12, 13, 14, 23 of the cylindrical helical spring 4 and is also provided with said cam-shaped surface 17 for engagement with the respective follower 18 mounted on the fixed body 2.

As will be clear to one skilled in the field, the engagement of the follower 18 with the cam 17, secured by the spring 16, allows making more or less difficult the relative displacement of the mobile body 1 with respect to the fixed body 2, for certain angular positions respectively achieved by the mobile body 1 with respect to the fixed body 2, therefore forcing the user to follow a particular law of motion for the actuation of the door.

Figure 5:
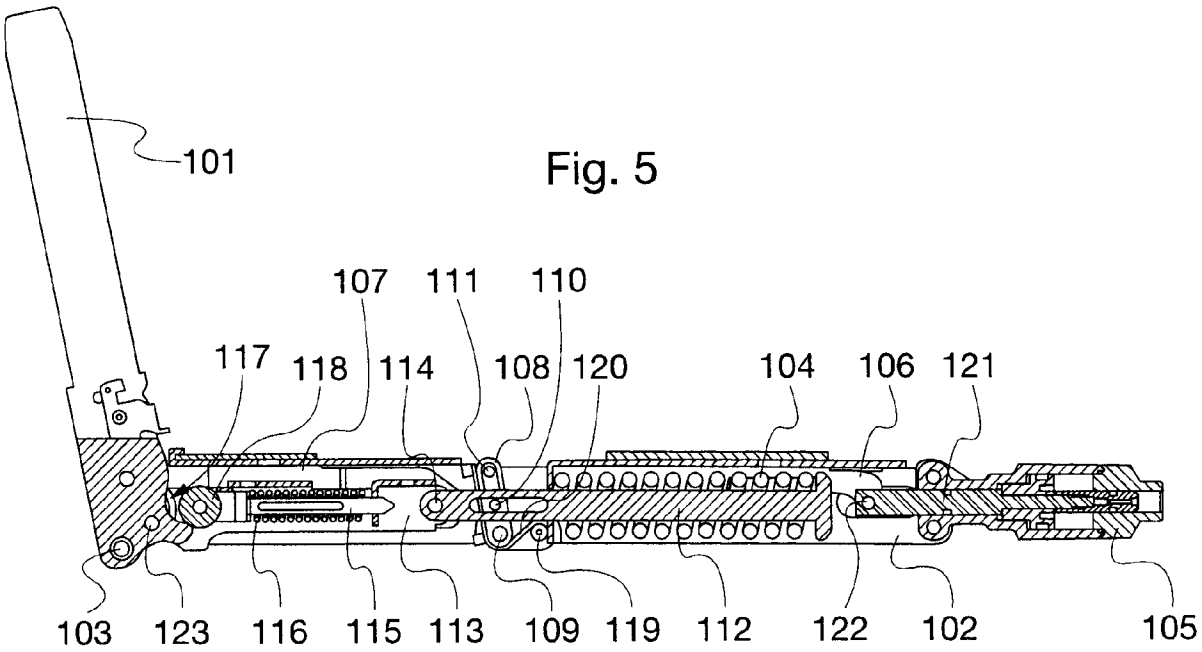
FIG. 5 is a side view partially in section of a hinge according to a further preferred embodiment of the present invention, seen in its intermediate position between opening and closing.
Figure 6:
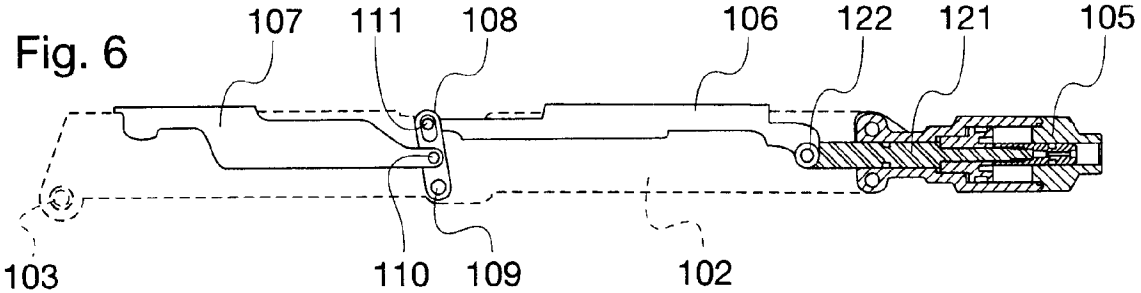
FIG. 6 is a partial side view of certain components of the hinge of FIG. 5, in which the dampener and the dampener actuating means are put in evidence.

Referring now to the hinge shown in FIGS. 5 and 6, according to another aspect of the present invention, said hinge comprises substantially all of the elements of the hinge shown in FIGS. 1-4 (which were simply renumbered by adding the number 100 in FIGS. 4 and 5 to corresponding numerical references of the hinge of FIGS. 1-4), and differs from the latter mainly for the fact that the dampener 105 of the hinge of FIGS. 5-6 is substantially aligned with the axis of the fixed body 2, while the dampener 5 of the hinge of FIGS. 1-4 is distanced from said axis of the fixed body 2.

Consequently, as can be particularly seen in FIG. 5, said hinge comprises a first mobile body 101 fixed to the door of a compartment, and a second fixed body 102, fixed to the frame of the aforesaid compartment, which are hinged to each other, at one of their ends, with a pin 103.

The hinge of FIGS. 5 and 6, which is particularly suitable for use on an oven, also comprises first elastic means which are preferably made of a cylindrical helical torsion spring 104, constrained at one extremity to the fixed body 102, and actuated by actuating means 112, 113, 114, 123, so as to exert a counteraction to the door opening movement, and a facilitating action for the closing movement of the latter. Said actuating means, similar to those described in relation to the hinge of FIGS. 1-4, comprise a first and a second rod-shaped element 112, 113, engaged one to the other in 114, where the first rod-shaped element 112, which serves as a spring-guide rod, acts upon the free end of the cylindrical helical spring 104, while the second rod-shaped element 113 is pivoted, at its non hinged end to the first rod-shaped element 112, to the mobile body 101.

The hinge of FIGS. 5-6, according to a particular aspect of the present invention also comprises a dampener 105, of fluid compression type by way of a piston sliding in a corresponding cylinder.

The dampener 105 is actuated, indirectly in this case, as will be said, by a first slider 106, pivotingly constrained, and thanks to a pin 111 mounted within a respective slot, also partially slidable, at one end of a one-armed lever 108, which in turn is pivoted at its other end, to the fixed body 102, by a pin 109.

The lever 108 is likewise hinged in an intermediate position, by a pin 110, which in this case is not slidable within a slot, a second slider 107, completely analogous to the second slider 7 described in relation to the hinge shown in FIGS. 1-4, and therefore configured to be actuated in translation by the mobile hinge body 101, only when it moves with respect to the fixed body 102 within a preset angular range, that in said hinge is located near the closing position of the door.

Also the hinge herein represented in FIGS. 5 and 6 provides the use of a wire spring 120 which, constrained to the fixed hinge body 102 by a tip 119, pushes the spring 108 and therefore the second slider 107 in the direction of the mobile body 101.

In the particular embodiment illustrated in FIGS. 5 and 6, with particular reference to the latter in which the dampener 105 and the respective actuating means are put in evidence, the actuating rod 121 of the dampener piston 105, unlike the hinge illustrated in FIGS. 1-4, is not directly connected to the aforesaid second slider 107, but is pivoted in 122 to the first slider 106, constrained in turn to the second slider 107 by way of the one-armed lever 108.

Note, as already mentioned, that while the first slider 106 actuating the dampener 105 is constrained to the one-armed lever 108 by a pin 111 which is mounted slidable within a slot obtained in the vicinity of one end of the lever 108 itself, the second slider 107 is pivoted, in a non-sliding manner within a slot, in correspondence to an intermediate position of that lever 108.

Finally, the hinge described herein, completely similar to the hinge of FIGS. 1-4, also comprises a follower 118, consisting especially of a swivelling roller pivoted to a rod 115, constrained slidable with respect to the fixed body 102 on the rod-shaped element 113. Said follower 118 is also pushed by third elastic means, consisting of a cylindrical helical torsion spring 116 in constant engagement with a cam-shaped surface 117, obtained on a projecting portion of the mobile body 101.

Note that, although described herein are two hinges in which the body 2, 102 is constrained to the compartment frame and the body 1, 101 is fixed to its respective door, naturally falls within the scope of protection herein requested also a hinge in which the body 2, 102 on which the various components described above are housed, is constrained to the door and thus mobile, and the body 1, 101 is constrained to the compartment door and is therefore fixed.

The operation of the hinge shown herein, for simplicity, with reference only to the hinge of FIGS. 1-4, is as follows.

Starting from the door opening position, shown in FIG. 4, the hinge is arranged in such a way that the mobile body 1 is substantially aligned with the fixed body 2, the cylindrical helical torsion spring 4 is compressed by the head of the spring-guide rod 12 with respect to its undeformed position, and therefore exerts to said head of the spring-guide rod a pushing action.

In this position, the wire spring 20, acting upon the one-armed lever 8, holds the second slider 7 of the dampener actuating means 5 in its position as close as possible to the mobile hinge body 1, but without engaging the slider 7 with the latter, and consequently the first slider 6 does not act upon dampener 5 which is located in such a configuration that the fluid within the respective cylinder does not exert any action upon its respective piston.

Additionally, the follower 18, pushed into engagement with the cam-shaped surface 17 of the first mobile body 1 by the cylindrical helical spring 16, contacts with one side of a "tooth" shaped region of the cam-shaped surface 17.

If the user's intent is to move the door fixed to the mobile hinge body 1 in its closed position (depicted in FIG. 2), he or she must act upon the mobile body 1, inducing rotation, clockwise in the figures, of the latter around the pin 3.

Figure 1:
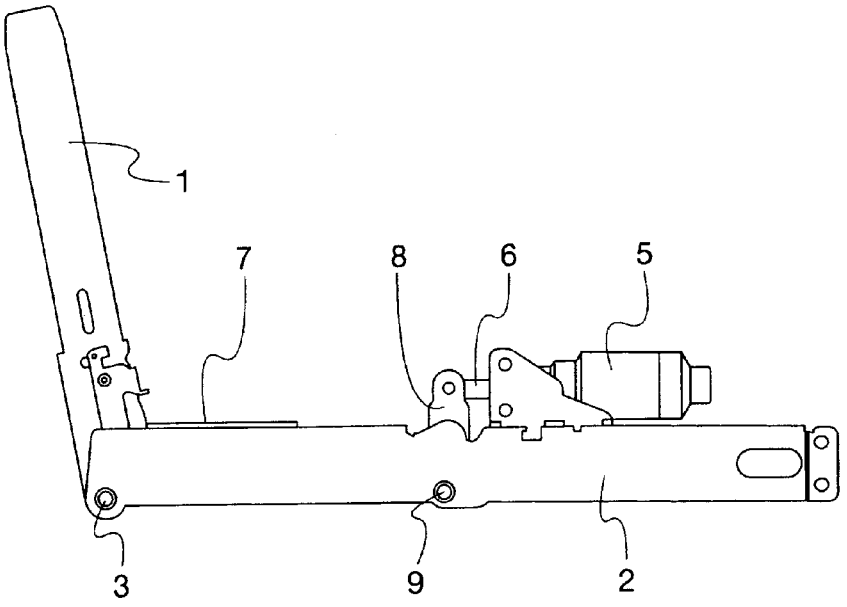
FIG. 1 is a schematic side view of a hinge according to a first preferred embodiment of the present invention.
Figure 2:
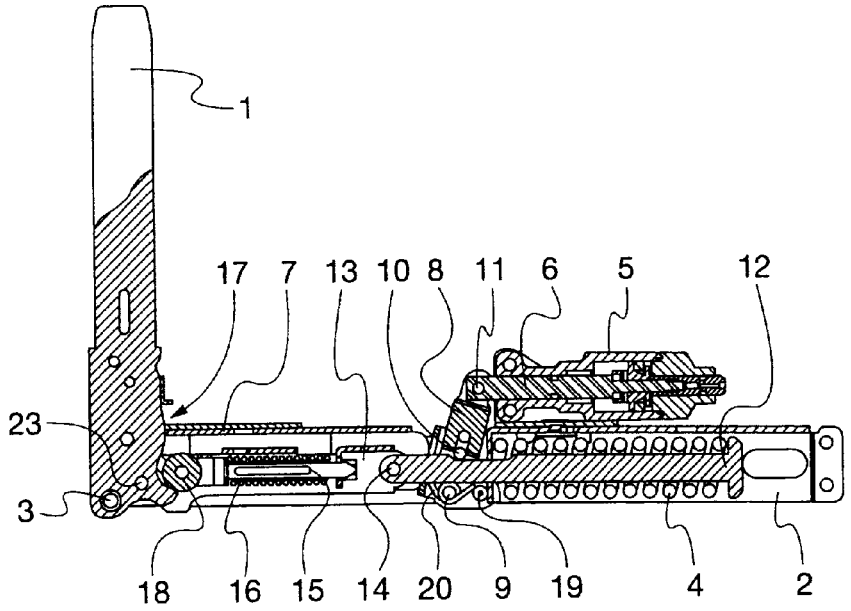
FIG. 2 is a side view in section of the hinge of FIG. 1, seen in its fully closed position.
Figure 3:
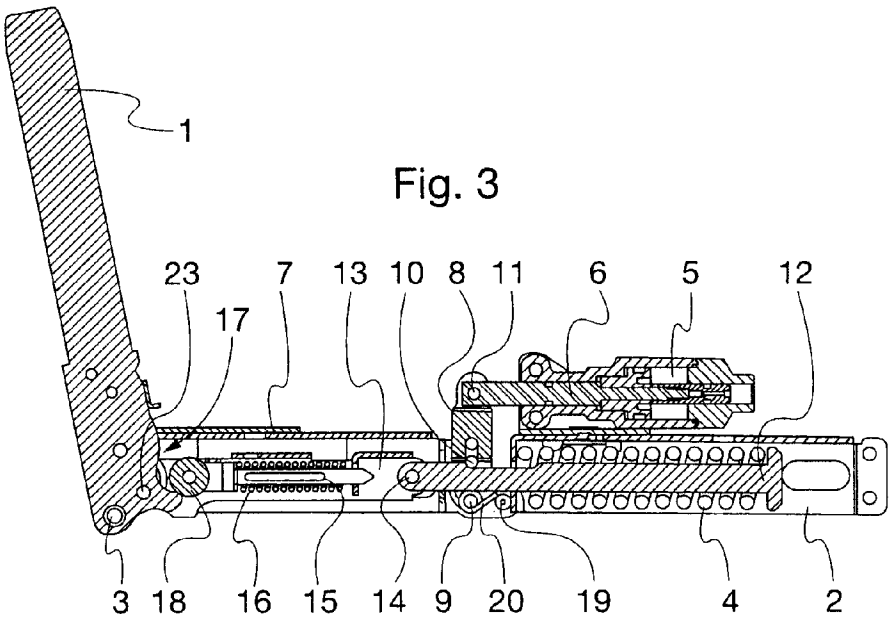
FIG. 3 is a side view partially in section of the hinge of FIG. 1 in its intermediate position.

Such rotation initially appears to be hampered by the engagement of the follower 18 with the tooth-shaped region of the cam-shaped surface 17, but, once the user has induced the follower 18 to overcome said tooth-shaped region (see FIG. 3) of the cam-shaped surface 17, the closing movement of the door is favored by the cylindrical helical spring 4, which acts upon the head of the spring-guide rod 12 to return to its undeformed position, and therefore indirectly, thanks to pin 14, to the rod-shaped element 13 and to the pin 23, also acts upon the mobile hinge body 1, facilitating the rotation of said mobile body 1 towards its closed door position, i.e. towards the position in which the mobile body 1 is at about 90° with respect to the fixed body 2 (as shown in FIG. 2).

During the closing rotation of the door, reached and passed a certain mutual angle between the mobile body 1 and the fixed body 2, a suitable region of the mobile body 1 rests on, and therefore drives in translation, the second slider 7 (see again FIG. 3), which, by the interposition of the lever arm 8, and overcoming the wire spring force 20, induces translation, albeit with displacements of a greater amount, in the first slider 6.

This translation of the first slider 6 implies the displacement of the piston within the dampener cylinder 5, resulting in compression of the fluid contained therein, and the respective dampening action exerted by the dampener 5 with respect to the further rotation of the mobile body 1 around the pin 3, due to the two sliders 6 and 7 and the respective lever 8, which constitute said constraining means between said first and second slider 6 and 7.

Note, as already mentioned, that the different distance from the pin 9 of rotation of the one-armed lever 8 to which the two sliders 6 and 7 are constrained, in 11 and 10, to the same lever 8, implies that by a modest displacement of the second slider 7, constrained by a pin 10 in an intermediate position of the lever 8, there is a greater displacement by the first slider 6, constrained by a pin 11 within a slot placed substantially at the free end of the lever 8, and therefore a larger displacement of the piston within the dampener 5.

Said effect of displacement amplification of the actuating shaft 6 of the dampener piston 5, due to the one-armed lever 8, implies a greater dampening action efficiency by the dampener 5 and makes the use of an expensive and cumbersome dampener designed and customized built unnecessary for functioning with small movements of the piston.

Moreover, this abovementioned displacement amplification effect implies that, despite the clearance due to wear of mechanical parts, a sufficient displacement of the actuating shaft 6 of the dampener piston is still guaranteed 5 for the proper and effective functioning of the dampener 5 itself.

The dampening action exerted by the dampener 5 terminates only when the second slider 7 stops, not being further urged by the mobile body 1, because the door to which the mobile body 1 is fixed has reached its fully closed position (FIG. 2). Note that this position corresponds to the substantially undeformed configuration of the cylindrical helical spring 4, and therefore does not substantially exert any action on the spring-guide rod 12, and the disposition of the follower 18 on the other inclined face of the abovementioned tooth-shaped region of the cam-shaped surface 17 of the mobile body 1.

When it is the user's intent to move the door from its fully closed position (FIG. 2) towards its fully open position (FIG. 4), he or she must act by turning counterclockwise in the figures, the mobile body 1 around the respective pin 3 with respect to the fixed body 2.

Said rotating action, initially counteracted by the elastic force of the follower 18 on said inclined wall of the tooth-shaped region of the cam-shaped surface 17 of the mobile body 1, is then facilitated in part, once the follower 18 has run past the apex of said tooth-shaped region, by the return to its uncompressed position of the dampener piston 5, and by the thrust of the wire spring 20, and therefore by the corresponding return action of the sliders 6 and 7 in the direction of the mobile body 1, at least for the part of the door opening stroke, and instead is progressively counteracted by the gradual compression of the cylindrical helical spring 4, made from the head-shaped spring-guide rod 12, by the indirect engagement, via the pins 23 and 14 and the rod-shaped element 13, with the same mobile body 1.

Once the open door position is reached, the mobile body 1, thanks to special stops not shown, then returns to its position substantially aligned with the fixed body 2 as described above, and illustrated in FIG. 4.

The invention claimed is:

1. A hinge for a closing door of a compartment, comprising:

a first and a second body, respectively configured for connecting to said door and to a frame of said compartment and said first and second body mutually hinged by at least one pin to allow angular rotation between said first and second body for a certain angular range, a first spring elastic means mounted on said second body and acting upon said first body, a dampening device fixed to said second body, and configured to act upon said first body, a first slider, functionally connected to said dampening device, a second slider mounted to said second body, configured for engaging, directly or indirectly, said first body in correspondence with said certain angular range of said first body with respect to said second body during said angular rotation, whereby said second slider, is actuated in translation by said first body a lever constraining said first slider to said second slider, wherein said lever is rotatably pivoted to said second body, said first slider and said second slider being constrained to rotate with said lever, wherein said lever is rotatably pivoted to said second body at a first end of its ends, wherein said first slider is constrained to said lever by a first pin, being rotatable and slidable within a first slot provided to a second end of said lever and is not pivoted to said second body, and wherein said second slider being constrained to said lever by a second pin, being rotatable and slidable within a second slot provided to said lever at a position intermediate said first end and said second end of said lever.

2. Hinge according to claim 1, wherein said hinge comprises a second spring elastic means acting on said lever, on said second slider, or on said first slider, for pushing said second slider in the direction of said first body.

3. Hinge according to claim 1, wherein said dampening device comprises at least one fluidic dampener.

4. Hinge according to claim 1, wherein said hinge comprises a rod-shaped actuating means for actuating said first spring elastic means, said rod-shaped actuating means comprising a first rod-shaped element, slidable with respect to said second body and acting upon said first spring elastic means, said first rod-shaped element being constrained, directly or indirectly, to said first body.

5. Hinge according to claim 4, wherein said rod-shaped actuating means for actuating said first spring elastic means further comprises a second rod-shaped element slidable with respect to said second body and hinged to said first body and to said first rod-shaped element.

6. Hinge according to claim 4, wherein said first spring elastic means comprises a cylindrical helical spring constrained at one end to said second body and urged in correspondence of the other end of said cylindrical helical spring by said first rod-shaped element of said rod-shaped actuating means.

7. Hinge according to claim 1, wherein said hinge comprises a follower slidable on a cam profile, said follower being slidingly coupled to said second body and being associated with a third spring elastic means, and said cam profile being obtained on said first body.

8. Hinge according to claim 7, wherein said third spring elastic means comprise at least one cylindrical helical spring.

9. Hinge according to claim 4, wherein said first body is configured as a lever with two arms, one of said arms constrained to said first rod-shaped element of said rod-shaped actuating means of said first spring elastic means.

10. Hinge according to claim 9 wherein a cam profile is obtained on the arm constrained to said first rod-shaped element of said rod-shaped actuating means of said first spring elastic means.

* * * * *